US011486217B2

(12) United States Patent
Riley et al.

(10) Patent No.: US 11,486,217 B2
(45) Date of Patent: Nov. 1, 2022

(54) FLOW CONTROL MODULE

(71) Applicant: FMC Technologies, Inc., Houston, TX (US)

(72) Inventors: Paul L. Riley, Houston, TX (US); Ramu Valliappan Manickam, Singapore (SG); Wei Soung Tan, Singapore (SG); May-Ling Rachel Ho, Singapore (SG); Guoxiang Calvin Wu, Singapore (SG)

(73) Assignee: FMC TECHNOLOGIES, INC., Houston, TX (US)

( * ) Notice: Subject to any disclaimer, the term of this patent is extended or adjusted under 35 U.S.C. 154(b) by 0 days.

(21) Appl. No.: 17/315,126

(22) Filed: May 7, 2021

(65) Prior Publication Data

US 2021/0262309 A1 Aug. 26, 2021

Related U.S. Application Data

(62) Division of application No. 16/305,697, filed as application No. PCT/US2016/034976 on May 31, 2016, now Pat. No. 11,021,924.

(51) Int. Cl.
*E21B 33/035* (2006.01)
*E21B 34/04* (2006.01)
(Continued)

(52) U.S. Cl.
CPC ..... *E21B 33/035* (2013.01); *E21B 34/04* (2013.01); *E21B 33/043* (2013.01); *E21B 33/064* (2013.01);
(Continued)

(58) Field of Classification Search
CPC .... E21B 33/035; E21B 33/043; E21B 33/064; E21B 33/076; E21B 34/04; E21B 43/013
See application file for complete search history.

(56) References Cited

U.S. PATENT DOCUMENTS 5,337,603 A * 8/1994 McFarland ..... G01F 1/206 73/202
6,823,941 B2 * 11/2004 Donald ..... E21B 33/035 166/368

(Continued)

OTHER PUBLICATIONS

Office Action issued in related U.S. Appl. No. 17/201,807 dated Jan. 10, 2022 (16 pages).

*Primary Examiner* — Aaron L Lembo
(74) *Attorney, Agent, or Firm* — Osha Bergman Watanabe & Burton LLP

(57) ABSTRACT

An assembly includes an inlet hub (112) coupled to a first flow passage (124) located within a flow control module, the first flow passage having a first flow bore, a flow meter (144) associated with the first flow bore and positioned for top-down fluid flow, a choke (109) disposed in a second flow passage (136) having a second flow bore, and an outlet hub (119) coupled to a distal end of the second flow passage. A system includes a flow control module assembly (902) having an inlet (912) and at least two outlets (914, 916), a main line (920) in fluid communication with the inlet, a first branch line (922) coupled to the main line and to a first outlet (916) of the at least two outlets, and a second branch line (924) coupled to the main line and to a second outlet (914) of the at least two outlets, and a tie-in connector (918) coupled to the inlet of the flow control module assembly.

14 Claims, 8 Drawing Sheets

(51) Int. Cl.

| | |
|---|---|
| ***E21B 33/043*** | (2006.01) |
| ***E21B 33/064*** | (2006.01) |
| ***E21B 33/076*** | (2006.01) |
| ***E21B 43/013*** | (2006.01) |

(52) U.S. Cl.
CPC ..... *E21B 33/076* (2013.01); *E21B 43/013* (2013.01); *E21B 2200/01* (2020.05)

(56) References Cited

U.S. PATENT DOCUMENTS

| | | | | |
|---|---|---|---|---|
| 8,151,890 | B2 * | 4/2012 | Spencer | E21B 33/035 166/352 |
| 9,169,709 | B2 * | 10/2015 | Vincent | E21B 43/01 |
| 9,309,740 | B2 * | 4/2016 | June | E21B 43/01 |
| 9,702,215 | B1 | 7/2017 | Murphy | |
| 10,174,575 | B2 | 1/2019 | Donald et al. | |
| 10,408,714 | B2 * | 9/2019 | Vethe | F16L 41/021 |
| 10,480,274 | B2 * | 11/2019 | Donald | E21B 43/013 |
| 10,947,803 | B2 | 3/2021 | Riley et al. | |
| 2013/0000918 | A1 | 1/2013 | Voss | |
| 2014/0116716 | A1 | 5/2014 | Vincent et al. | |
| 2015/0027730 | A1 | 1/2015 | Hall et al. | |
| 2016/0097248 | A1 | 4/2016 | Mathieson et al. | |
| 2019/0284901 | A1 * | 9/2019 | Murphy | E21B 34/04 |

* cited by examiner

FLOW CONTROL MODULE

CROSS-REFERENCE TO RELATED APPLICATIONS

This application is a divisional application of U.S. application Ser. No. 16/305,697, filed on Nov. 29, 2018, which is a National Stage Entry of International Application No. PCT/US2016/034976, filed May 31, 2016. Each of these applications is incorporated herein by reference in its entirety.

BACKGROUND

Flow control modules may be useful in the process of extracting and managing wells that are drilled into the earth to retrieve one or more subterranean natural resources, including oil and gas. Flow control modules may be utilized both offshore and onshore. In offshore environments, flow control modules are particularly useful in directing and managing the flow of fluids (e.g. oil and/or gas) from one or more subsea wells, including satellite wells. A flow control module is a structure having a set of pipes and components through which fluid, such as oil and gas, may flow. Further, flow control modules may include a number of flow control devices, including chokes, and may also include a number of instruments or devices for measuring and obtaining pertinent data about the fluid flowing through the one or more pipes located in the flow control modules.

When used in a marine environment, a subsea flow control module may be landed and locked adjacent to a subsea tree or other subsea structures. As part of field architecture and planning, the location of subsea trees around one or more wells involves the planning for flow control modules that assist in routing the fluids produced from the wells to another subsea structure or to a riser pipeline for further processing.

Flow lines are often used to interconnect a flow control module to another subsea structure as part of a subsea oil and gas field layout for fluid communication. Such flow lines may generally be rigid or flexible hoses or pipes that are provided with subsea mateable connectors at either end. Such flexible hoses or pipes are known in the art as jumpers or spools, and may be used to connect several wells and other subsea equipment together.

SUMMARY

In one aspect, the embodiments disclosed herein relate to an assembly including an inlet hub coupled to a first flow passage located within a flow control module, the first flow passage having a first flow bore, a flow meter associated with the first flow bore and positioned for top-down fluid flow, a choke disposed in a second flow passage having a second flow bore, the second flow passage coupled to a distal end of the first flow passage, and an outlet hub coupled to a distal end of the second flow passage.

In another aspect, embodiments disclosed herein relate to a method for using a flow control module assembly including connecting an inlet hub of the flow control module assembly to a flow passage of a subsea tree, connecting an outlet hub of the flow control module assembly to a flowline, directing fluid from the flow passage of the subsea tree through the inlet hub of the flow control module assembly, directing the fluid down through a first flow passage located in the flow control module assembly, directing the fluid through a second flow passage coupled to a distal end of the first flow passage, directing fluid through the second flow passage to the outlet hub, wherein the outlet hub is located on a distal end of the second flow passage, and directing the fluid from the outlet hub to a connected flowline.

In another aspect, embodiments disclosed herein relate to a system including a flow control module assembly having an inlet and at least two outlets, a main line that is in fluid communication with the inlet, a first branch line coupled to the main line and to a first outlet of the at least two outlets, and a second branch line coupled to the main line and to a second outlet of the at least two outlets, and a tie-in connector coupled to the inlet of the flow control module assembly, wherein an equipment device is coupled to the tie-in connector.

In another aspect, embodiments disclosed herein relate to method of using a flow control module assembly, the method including connecting a first flow control module assembly having at least one branch line and a main line to an equipment device including connecting a main line of the first flow control module assembly to the equipment device, and flowing fluid through the main line of the first flow control module assembly to the at least one first branch line; and connecting a main line of a second flow control module to the at least one branch line of the first flow control module and flowing the fluid from the first flow control module through the main line of the second flow control module.

This summary is provided to introduce a selection of concepts that are further described below in the detailed description. This summary is not intended to identify key or essential features of the claimed subject matter, nor is it intended to be used as an aid in limiting the scope of the claimed subject matter.

DETAILED DESCRIPTION

Figure 1:
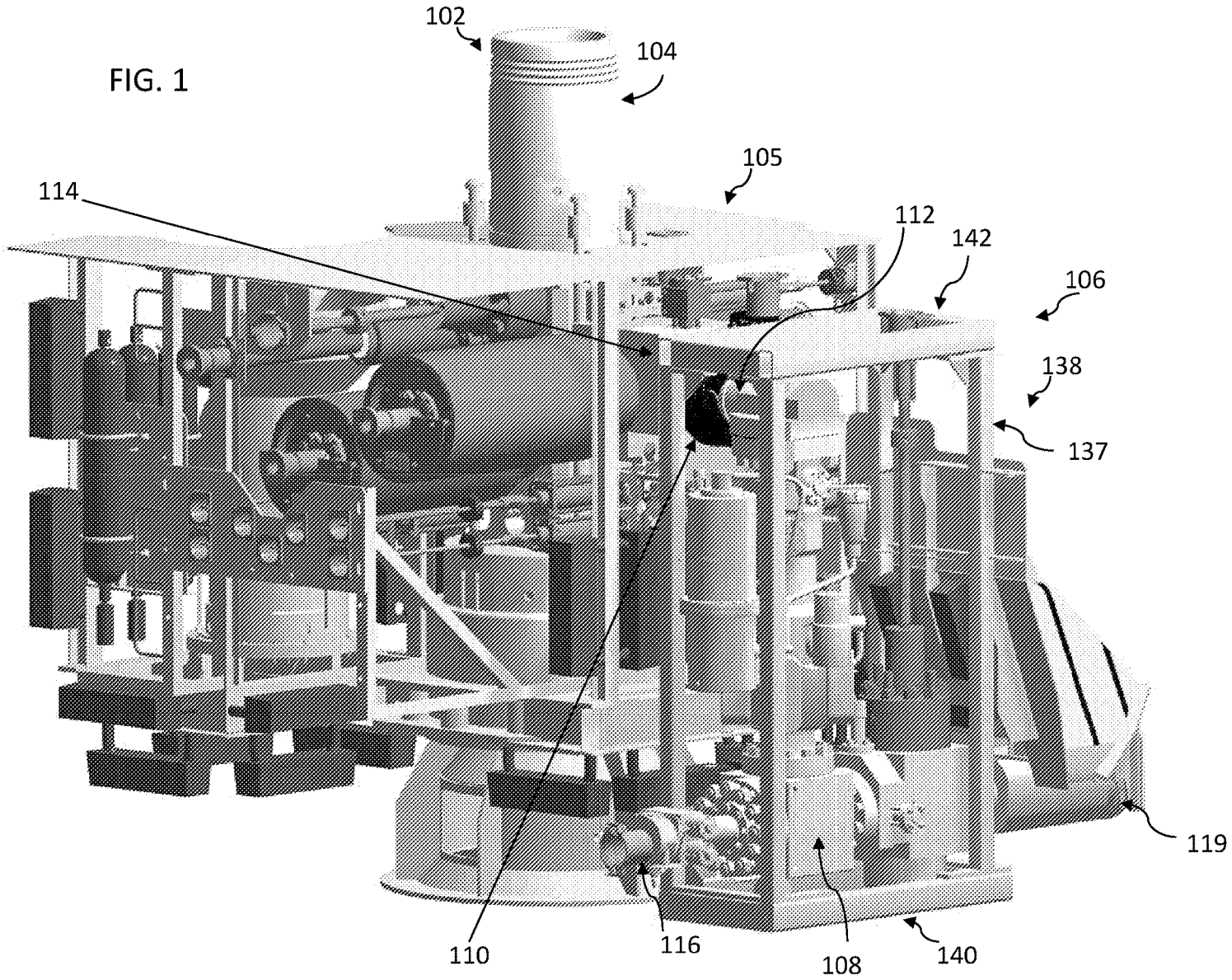
FIG. 1 is a perspective view of a flow control module assembly coupled to a subsea tree in accordance with one or more embodiments of the present disclosure.

In one aspect, embodiments disclosed herein relate to flow control modules. A flow control module may also be interchangeably referred to as a flow control module assembly in the present disclosure. As used herein, the term "coupled" or "coupled to" or "connected" or "connected to" may indicate establishing either a direct or indirect connection, and is not limited to either unless expressly referenced as such. Wherever possible, like or identical reference numerals are used in the figures to identify common or the same elements. The figures are not necessarily to scale and certain features and certain views of the figures may be shown exaggerated in scale for purposes of clarification.

Flow control modules are apparatuses that include multiple pipes and components that are arranged in a certain layout and contained within a frame or frame housing. The pipes or conduits included in flow control modules may be used to direct fluid produced from or injected into a subsea well. As used herein, fluids may refer to liquids, gases, and/or mixtures thereof. In addition, one or more chokes may be disposed in one of the pipes or passageways of a flow control module. As known in the art, a choke may be an apparatus used to control pressure of fluid flowing through the choke and also may control a back pressure of a corresponding downhole well. Other instruments and devices, including without limitation, flow meters, sensors, and various valves may be incorporated within a flow control module.

Conventional flow control modules in the oil and gas industry are typically very large and heavy. Conventional flow control modules may include an extensive layout and arrangement of pipes that weigh several tons each. In some instances, a pipe used to direct fluid into another pipe may be ten inches in diameter and may include complicated bends or changes in orientation. Such flow control modules may be both heavier in weight and may also be more expensive to manufacture because of the higher number of parts and components. For example, in order to connect conventional flow control modules to a flowline, such as a well jumper (i.e., a pipe with a connector on each end) additional pipe work is required to be connected from conventional flow control modules to the well jumper. This additional pipework needed to connect a flow control module to a well jumper adds to the weight, installation costs, and overall cost of flow control systems such as a flow control module.

In addition to the above, conventional flow control modules typically include one or more flow meters that measure various properties or conditions of a fluid. Conventional flow control modules include one or more flow meters oriented for "bottom-up" flow of fluid, which usually requires adding intermediate pipework that further adds to the weight and cost of assembling such a flow control module.

Subsea flowlines are often used for the transportation of crude oil and gas from other subsea structures. Examples of subsea structures that may be interconnected or connected to one of the flowlines mentioned above include without limitation subsea wells, manifolds, sleds, Christmas trees or subsea trees, as well as Pipe Line End Terminations (PLETs), and/or Pipe Line End Manifolds (PLEMs). Examples of subsea flowlines include without limitation jumpers and spools. Further, subsea flow lines may include flexible or rigid flowlines, including rigid jumpers, rigid flowlines with flexible tails and flowline risers. Achieving a successful tie-in and connection of subsea flowlines is an important part of a subsea field development. Additional challenges further exist in a subsea environment for connection from one structure to another while both minimizing costs and providing flexibility for future changes to the overall layout of a field or well.

Accordingly, one or more embodiments in the present disclosure may be used to overcome such challenges as well as provide additional advantages over conventional flow control modules as will be apparent to one of ordinary skill. In one or more embodiments, a flow control module assembly may be lighter in weight and lower in cost as compared with conventional flow control modules due, in part, to an incorporation of a flow meter capable of operating with top-down fluid flow and to a reduced number of parts and pipes necessary for a flow control module having a top-down fluid flow. Further, according to embodiments of the present disclosure, a flow control module may be directly connected to a flowline such as a well jumper or similar flowline instead of requiring additional pipework to connect the flow control module to the flow line, thus reducing cost and weight of such a flow control module.

Further, in one or more embodiments, a flow control module assembly may include more than one outlet, including two or three outlets. In addition, a flow control module assembly may be arranged in series to distribute and manage fluid flow over a wider area in some instances and to connect to multiple subsea equipment.

Turning to FIG. 1, FIG. 1 shows a perspective view of a flow control module assembly coupled to a subsea tree in accordance with one or more embodiments of the present disclosure. In one or more embodiments, subsea tree 104 may be coupled to a downhole well or a well head. As known in the art, a subsea tree, such as subsea tree 104 may be a structure useful for producing fluid or injecting fluid into a downhole well, and is often a complex configuration of actuated valves and other components having various functions relevant to the downhole well. It is noted that subsea tree 104 in one or more embodiments may be configured as a horizontal or vertical subsea tree. Subsea tree 104 may include subsea tree frame 105, which surrounds or encases the vertical body of subsea tree 104. Subsea tree 104 is a separate subsea structure from flow control module 106. As known to those of ordinary skill in the art, a blowout preventer (BOP) (not shown) may be coupled to a top hub 102 of subsea tree 104.

Figure 3:
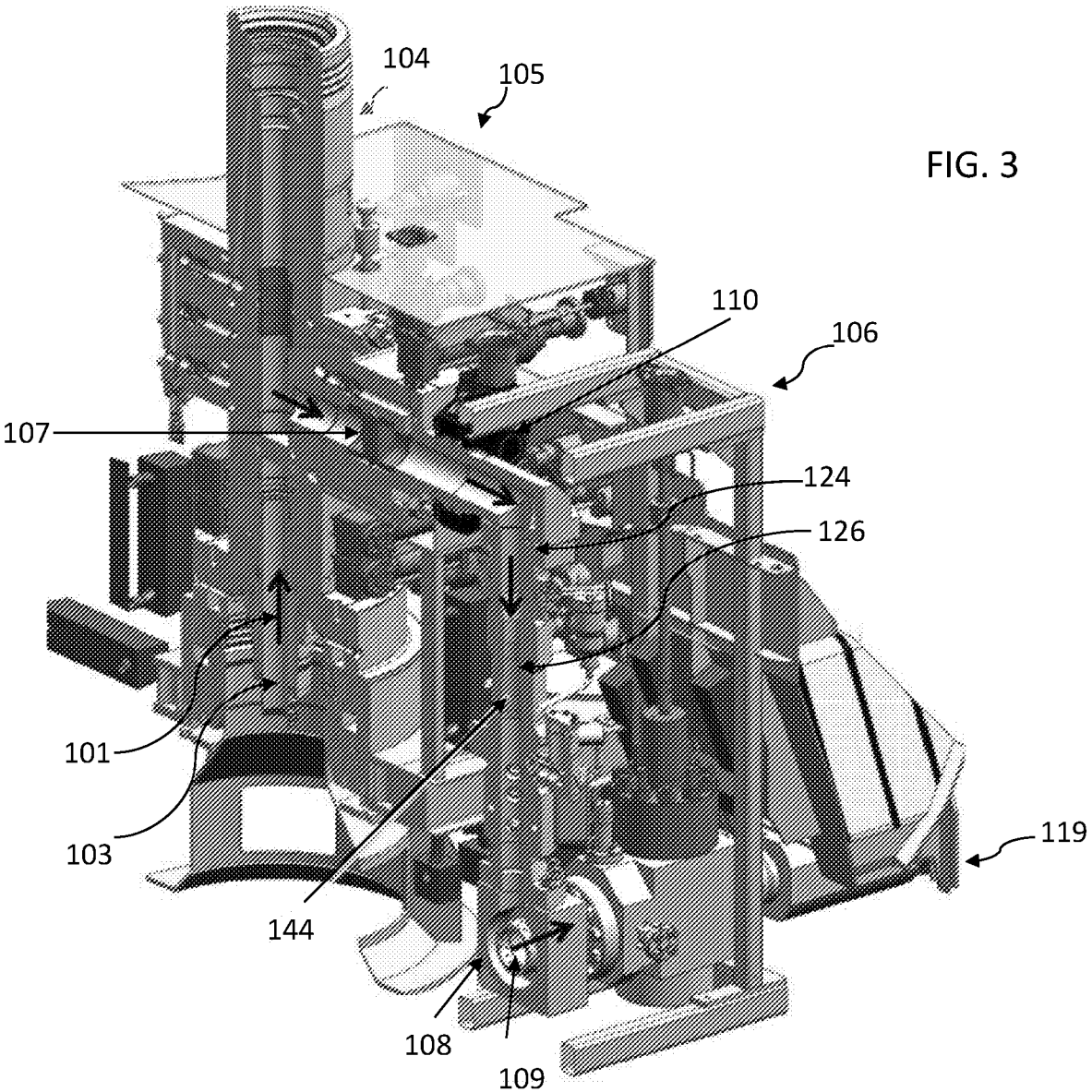
FIG. 3 is a cross-sectional view of the flow control module assembly of FIG. 2 in accordance with one or more embodiments of the present disclosure.

In one or more embodiments, subsea tree 104 may include a production wing block 114 or the wing valve 107 may be incorporated into the main body of the tree. Fluids from subsea tree 104 may flow to production wing block 114, including in some embodiments, flowing up a vertical borehole (e.g. vertical borehole 103 in FIG. 3) of subsea tree 104. Further, production wing block 114 may include a production wing valve 107 as shown in FIG. 3. A wing valve is a valve that may be selectively closed or opened to control the flow of fluid from a body of subsea tree 104 and through a flow passage of production wing block 114.

In one or more embodiments, flow control module 106 may be used to direct fluid flowing from subsea tree 104 to another subsea structure or distribution point for storage and/or processing.

A subsea structure may refer without limitation to a subsea tree, a manifold, a PLEM, or a PLET. A manifold (not shown) is a subsea structure, as known in the art, may be an arrangement of piping or valves designed to collect the flow from multiple wells into a single location for export and to provide control, distribution and monitoring of the fluid flow. In other embodiments, the fluid flowing from flow control module 106 may be directed to a PLEM or a PLET.

In one or more embodiments, subsea tree 104 is connected to flow control module 106. In one or more embodiments, connector 110, as shown in FIG. 1, is used to connect production wing block 114 or the tree main body with flow control module 106. Connector 110 may be any type of connector known in the art, including without limitation a collet connector, a clamp connector, or a flanged connector.

Connector 110 may be any type of connector known in the art and may be oriented horizontally, vertically, or at any angle in between. In one or more embodiments, connector 110 is a horizontal connector that connects with inlet 112 of flow control module 106, whereby inlet 110 is oriented for a horizontal connection, such as a collet connector, a clamp connector, or flanged connector. By connecting the flow control module 106 directly to the production wing block 114, an intermediate flow loop (including welded pipe, flanges, and elbows) is not needed. According to embodiments of the present disclosure, a horizontal connection (or in some instances an angled connection) to a production wing block located on subsea tree 104 and to a well jumper (not shown) may naturally protect critical sealing surfaces of those connections from dropped object impact. The flow control module 106 may be coupled to the tree frame 105 and supported by the production win block 114. In other embodiments, the flow control module 106 may be supported by another structure mounted to a conductor housing.

In one or more embodiments, an adaptor spool or flow loop (not shown) may be used between production wing block 114 and a connector used to connect flow control module 106 to tree frame 105 (e.g. via connector 110). In some embodiments, the connector is coupled (for example, by bolting or other mechanical means) on to the production wing block 114 instead of being an integral component.

Figure 4:
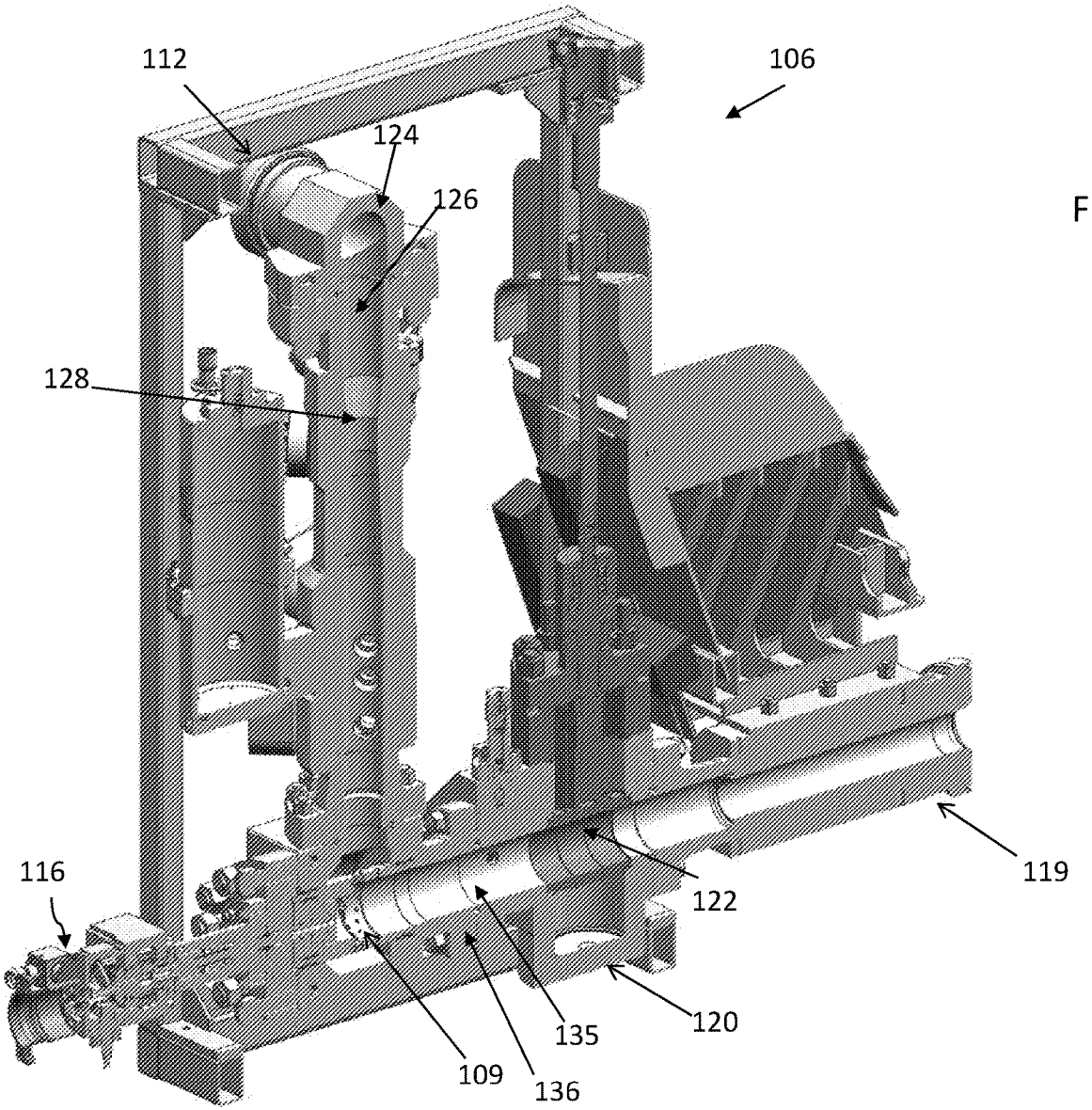
FIG. 4 is a cross-sectional view of the flow control module assembly coupled to a subsea tree of FIG. 1 in accordance with one or more embodiments of the present disclosure.
Figure 7:
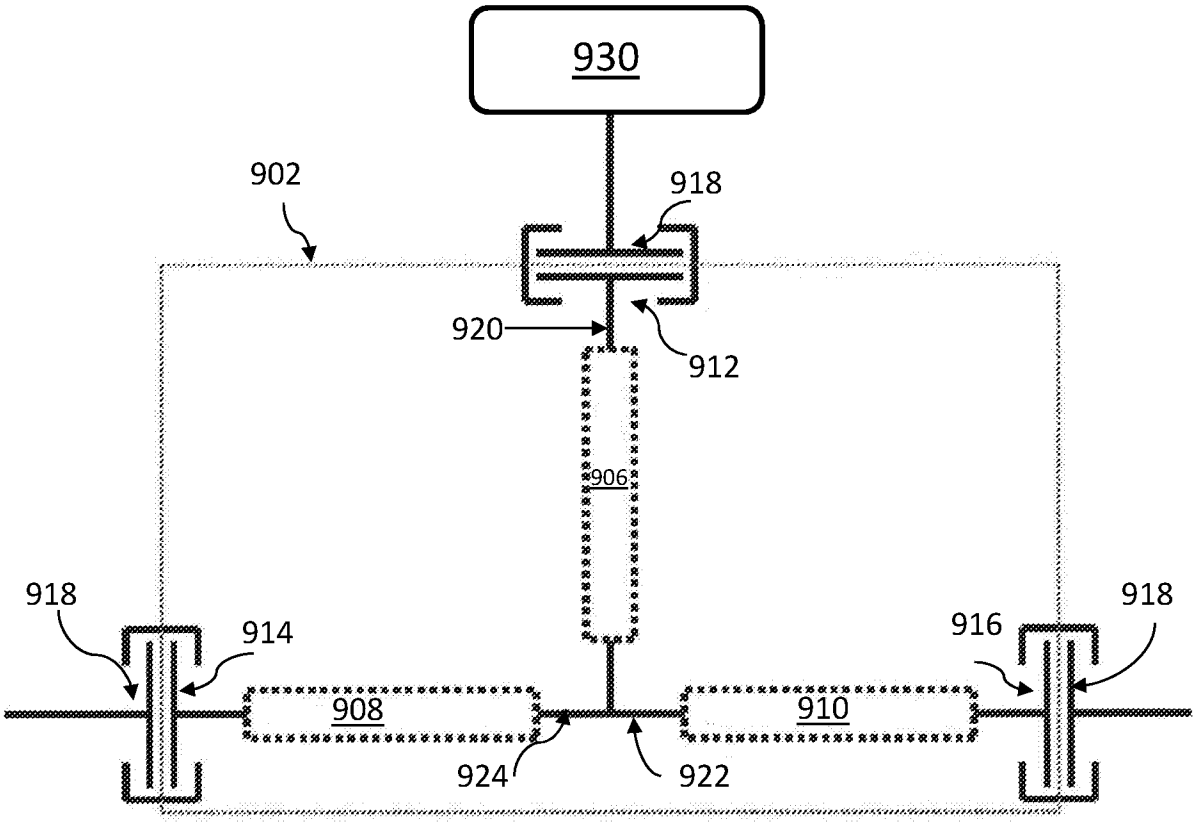
FIG. 7 shows a schematic view of a flow control module assembly having at least two outlets in accordance with one or more embodiments of the present disclosure.
Figure 8:
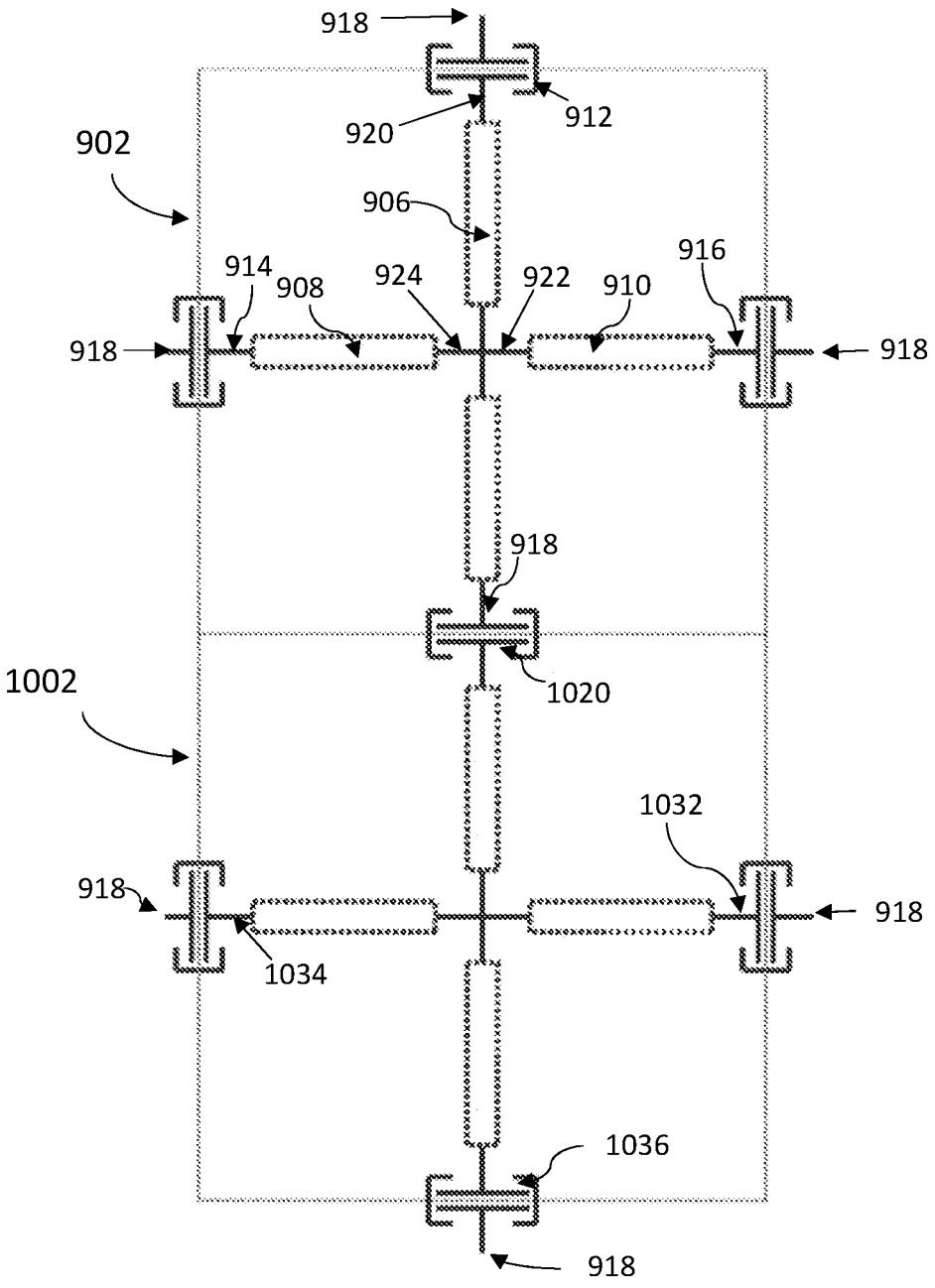
FIG. 8 shows a schematic view of two flow control module assemblies coupled in series having at least three outlets for each flow control module assembly in accordance with one or more embodiments of the present disclosure.

According to embodiments of the present disclosure, flow control module 106 includes inlet 112, outlet 119, flow passage 124 and flow passage 136 (as shown in FIG. 4). One of ordinary skill in the art will appreciate that these elements are not limited to any specific orientation. Inlet 112 provides an entrance into flow control module 106 and outlet 119 provides an exit out of flow control module 106. According to one or more embodiments, fluid flowing from subsea tree 104 may flow into inlet hub 112 of flow control module 106 and be directed out of flow control module 106 through an outlet hub of flow control module (e.g. outlet hub 119). As shown in FIGS. 1-5, the outlet hub 119 may be a single outlet; in other embodiments, as shown in FIGS. 7 and 8, the outlet hub may include multiple outlets. Furthermore, each outlet may include one or more bores for flowing hydrocarbons or injection fluids.

In one or more embodiments, flow control module 106 may include a direct connection to production wing block 114 of subsea tree 104.

As shown in FIG. 1, flow control module 106 may include frame 138 made up of a plurality of frame support members. Frame 138 generally contains the components and pipework of flow control module 106. In one or more embodiments, flow control module 106 is retrievable such that frame 138 and the entirety of the components located within flow control module 106 may be retrieved to the surface for maintenance or replacement. Accordingly, frame 138 may include a top end 142 and a bottom end or base 140. Further, side support members 137 may be connected to top end 142 and base 140 to form frame 138. Various fasteners and attaching mechanisms as known in the art may be used to connect the frame support members together including without limitation brackets, bolts, screws, etc. In other embodiments, frame 138 may be integrally formed of any type of material, including metals, composites, etc.

The components of the flow control module 106, including inlet 112, outlet 119, vertical flow passage 124, and horizontal flow passage 136 may be attached to one or more frame support members of frame 138 using various methods as known in the art, including without limitation mechanical fasteners, welding, integrally forming, adhesives, etc.

In one or more embodiments, flow control module 106 may further include a choke block 108. Choke block 108 may include a choke (e.g., choke 109 as shown in FIG. 3) which may control pressure by controlling the size of an opening located in the choke through which a fluid passes. In one or more embodiments, choke 109 disposed in choke block 108 may be included in a flow passage of flow control module 106. In accordance with one embodiment, choke 109 may be located in a horizontal flow passage 136 as shown in FIG. 4.

Choke 109 may include a choke body that may be permanently or removably fixed to choke block 108. One or more seals and retention mechanisms (such as a clamp or crown or bonnet) may be used to hold choke 109 in place. Further, one or more actuators, such as choke actuator 116 may be used to actuate or operate choke 109. As illustrated in FIG. 1, choke actuator 116 may be disposed on one side of choke block 108 and may include one or more actuating mechanisms. Further, as shown in FIG. 3, choke 109 may be included in a horizontal flow passage 136 of flow control module 106. According to one or more embodiments, choke 109 may be disposed beneath a lower end of vertical flow passage 126.

In one or more embodiments, choke 109 may be either a fixed choke or adjustable choke. A fixed (also known as positive) choke conventionally has a fixed aperture (orifice) used to control the rate of flow of fluids. An adjustable (or variable) choke has a variable aperture (orifice) installed to restrict the flow and control the rate of production from the well. Choke 109 may be a variable choke, such that the choke may include a mechanism that allows changing the size of the opening to control both the flow rate of the fluid passing through choke 108 and a pressure associated with the fluid. Choke 109 may operate such that the larger the opening through the choke, the higher the flow rate. A larger opening in the choke creates a smaller pressure drop across the choke, and hence, a higher flowrate. Likewise, a smaller opening in the choke results in a higher pressure drop and a lower flow rate. In one or more embodiments, choke 109 may be an adjustable choke, a fixed or positive type choke, or any other type of choke known in the art.

Those of ordinary skill in the art will appreciate that choke 109 may be actuated via choke actuator 116 and one or more mechanisms through different methods including electric and hydraulic actuators. For example, choke 109 disposed in choke block 108 may be mechanically adjusted by a diver or a remotely operated vehicle (ROV), or may be adjusted remotely from a surface control console.

In accordance with one or more embodiments, choke 109 may incorporate any choke trim suitable for the optimal performance and control of the fluid expected to flow into and out of choke 109. Choke trim as understood in the art may be a pressure-controlling component of a choke and controls the flow of fluids. Choke trim design types include, without limitation, needle and seat, multiple orifice, fixed bean, plug and cage, and external sleeve trims. Sizing of the choke 109 may also depend on a myriad of factors unique to the type of fluid flowing through choke 109. Thus, choke block 108 may include any type of choke as understood in the art and be of any size useful for the specific flow parameters of the subsea tree 104.

In accordance with one or more embodiments, flow control module 106 may include a connector such as a flowline jumper connector (not shown). The flowline connector may facilitate a direct connection to an outlet hub 119 of flow control module 106. For example, a flowline, such as a jumper, jumper spool, or umbilical, may be directly connected to flow control module 106 at outlet hub 119. Thus, the connector connects to one end of a jumper, jumper spool, or umbilical, and the other end of the jumper, jumper spool, or umbilical may connect to another subsea structure, such as a manifold, a subsea tree, PLET, PLEM, in-line tees, riser bases, etc. In one or more embodiments, the connection may include, for example, a collet- or clamp-based connector. In certain embodiments, the connection may be part of an ROV-operated connection system that may be used for the horizontal or vertical connection of rigid or flexible flowlines, such as without limitation jumpers, spools, and umbilicals towards other subsea structures, such as manifolds, subsea trees, PLETs, PLEMs, in-line tees, riser bases, etc. Having a horizontal connection may advantageously allow flow control module 106 to not "hinge over" to connect to a flow line. In accordance with embodiments disclosed herein, the flow control module is run with the flowline jumper and is rotated approximately 90 degrees to allow the connection to the tree to be made up.

It is noted that the ability to directly connect from outlet hub 119 to a flowline, such as a jumper, spool, or umbilical, without inclusion of or with a reduced number of additional pipes and adaptors, may enable flow control module 106 to be lighter in weight. Specifically, a flowline jumper connector connects directly to the outlet hub 119 so that the flowpath of fluid exiting the flow control module does not reenter the tree assembly. Further, flow control module 106 may reduce the manufacturing and installation costs for flow control module 106.

Figure 2:
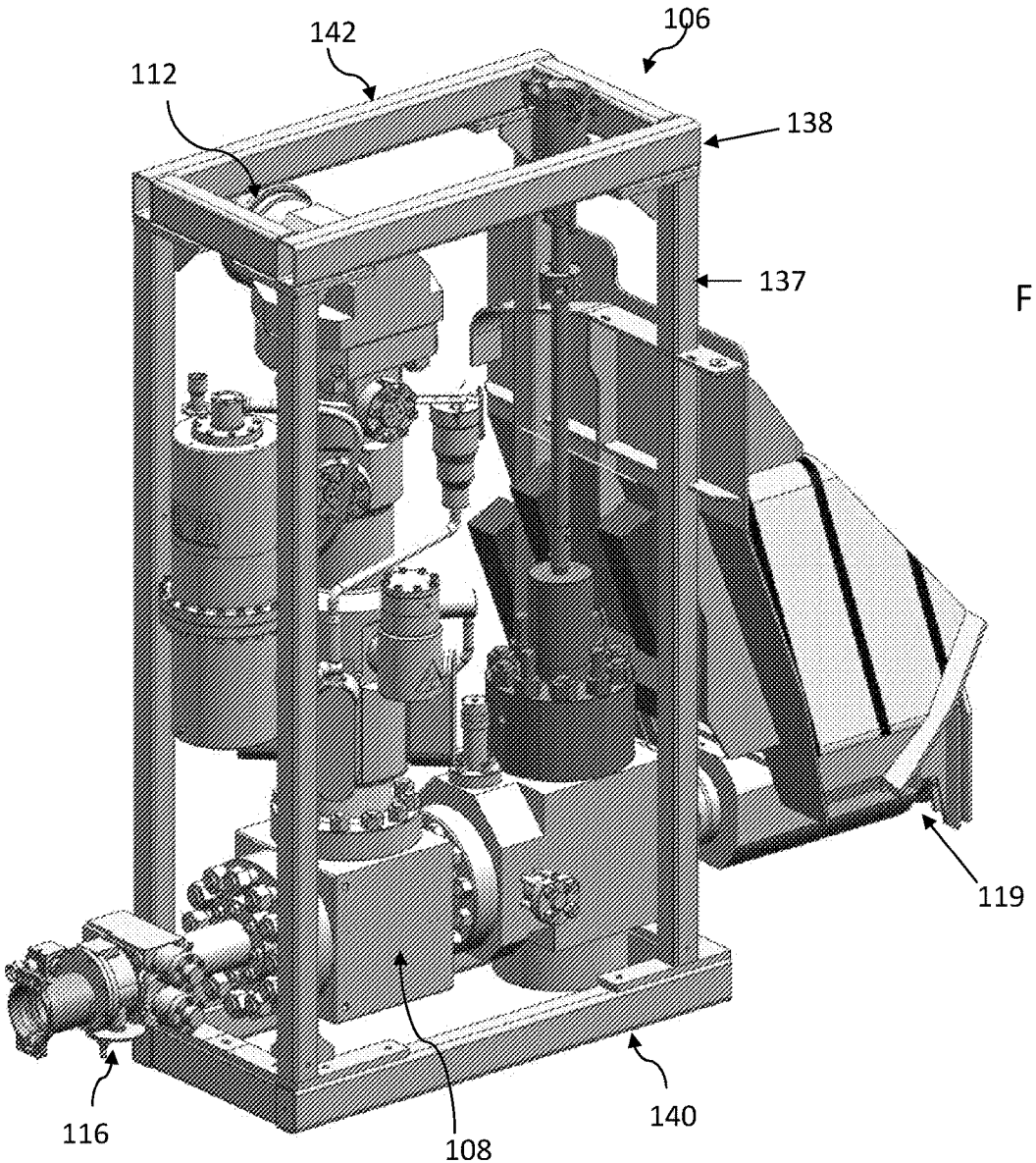
FIG. 2 is a perspective frontal view of a flow control module assembly in accordance with one or more embodiments of the present disclosure.

Turning to FIG. 2, FIG. 2 shows a perspective view of flow control module 106. Flow control module 106 in FIG. 2, includes the same elements as discussed above with respect to FIG. 1. In particular, flow control module 106 in FIG. 2 may include a frame 138 having a top end 142, a bottom end or base 140, and one or more side support members 137 that further form frame 138. Frame 138 may act as the housing that supports and/or encases one or more components of flow control module 106, including choke block 108 and choke actuator 116. Further, FIG. 2 shows inlet 112 of flow control module 106 and outlet hub 119.

FIG. 3 shows a cross sectional view of the flow control module assembly of FIG. 2 in accordance with one or more embodiments of the present disclosure. As shown, flow control module 106 includes vertical flow passage 124 having vertical flow bore 126. Fluid flowing from inlet hub 112 (from, e.g., subsea tree 104) may flow through the conduit connected to inlet hub 112 and down through vertical flow bore 126.

In one or more embodiments, a flow meter 144 may be positioned within vertical flow bore 126. A flow meter as known by those in the art may be used to measure one or more properties or condition of flow of a fluid. In one or more embodiments, flow meter 144 may be a multi-phase flow meter. In other embodiments, flow meter 144 may be a wet gas flow meter or a single phase flow meter. In other embodiments, flow meter 144 may be removed (i.e., the vertical flow bore 126 may not include a flow meter) and/or configured to include virtual metering, in which the flow is not measured directly but is determined, calculated, or otherwise extrapolated from indirect measurements such as pressure and temperature measurements. In such embodiments, the flow control module may be said to include a "virtual meter."

In accordance with embodiments of the present disclosure, flow meter 144 may be "inverted" (as compared to conventional flow meters) and configured for a top-down flow regime (as shown in FIG. 4), whereby fluid flows down through vertical flow bore 126 and through flow meter 136. Such an orientation reduces or eliminates settling of the liquid phase of the fluid which may interfere with sensor measurements if the meter is horizontally oriented and allows a reduction in size and weight of the equipment when compared to a conventionally oriented meter with a "bottom up" flow direction.

Further, flow control module 106 may include a number of additional instruments and devices useful in monitoring a fluid flowing through flow control module 106. Such instruments and devices may include chemical meters, pressure and/or temperature sensors, erosion probes, densitometers, or other instruments/devices known in the art.

In one or more embodiments, a production isolation valve 120 (shown in FIG. 4) may be incorporated into the flow passage. An isolation valve as known to one of ordinary skill in the art may be used as a control valve in a fluid handling system that stops the flow of fluid to a given location, usually for maintenance or safety purposes. An isolation valve may further be used to provide flow logic (selecting one flow path versus another), and to connect external equipment to a system. A passageway 122 may be aligned with production isolation valve 120 to direct fluid through passageway 122 as needed, for example, for maintenance or safety purposes.

FIG. 3 illustrates a cross-sectional view of the flow control module assembly coupled to a subsea tree of FIG. 1 in accordance with one or more embodiments of the present disclosure. As shown in FIG. 3 subsea tree 104 may be coupled to flow control module 106. Arrows 101 in FIG. 3 show a flow path for fluids flowing from a reservoir and well bore (not shown) located beneath subsea tree 104. Accordingly, in one or more embodiments, subsea tree 104 may be adapted for use as a production subsea tree. However, it is noted, that subsea tree 104 may be configured for use with injection services and flow control module 106 may be adapted for use for injection services as well, which is further discussed below.

In accordance with one or more embodiments, fluids flowing up from a reservoir or well may flow upwardly through a vertical flow bore 103 of subsea tree 104 (as shown in FIG. 3). As known to those of ordinary skill in the art, subsea tree 104 may include one or more master valves (not shown) and/or swab valves (not shown) as well as additional components to regulate the flow of fluids through flow bore 103.

In accordance with one embodiment, FIG. 3 illustrates that a fluid may flow (along the flow path shown by arrows 101) through production wing valve 107 located in production wing block 114 (as shown in FIG. 1). Connector 110 connects production wing block 114 of subsea tree 106 to an inlet hub 112 (as shown in FIGS. 1 and 2) of flow control block 106. Fluid may proceed to flow through inlet hub 112 and to a vertical flow passage of flow control module 106, such as vertical flow passage 124, having a vertical flow bore 126. Fluid may flow through vertical flow passage 126. Fluid may then flow through choke 109, which is actuated by choke actuator 116, thereby regulating a pressure of the flowing fluid. The fluid from a reservoir or well (not shown) may proceed to flow through the horizontal flow bore 135 of horizontal flow passage 136 in flow control module 106. The fluid may proceed to flow to outlet hub 119 of flow control module 106 and to any connected subsea structure, including one or more flowlines.

Flow control module 106 thus provides a flow path for fluid to flow with a lighter weight and reduced number of bends and turns because of the top-down flow configuration. As discussed above, flow control module 106 may include a top-down flow meter (e.g. flow meter 144) which does not require additional piping for routing fluid to the top down flow meter 144. Further, flow control module 106 includes, in one or more embodiments, a horizontal connection between production subsea tree 104 and flow control module 106 as well as between outlet hub 119 and another subsea tree, which further reduces the weight and number of necessary pipes in the overall structure of flow control module 106.

As noted above, subsea tree 104 may be used for fluid injection services into a downhole well or reservoir. Accordingly, a flow control module 106 may be configured for well injection services also. In such instances, choke block 108 may be located at an upper end of a vertical flow passage (e.g., vertical flow passage 124 in FIG. 4) located in the flow control module. In one or more embodiments, a flow meter may be positioned within vertical flow passage 124 and configured for a more traditional bottom-up flow regime.

Figure 5:
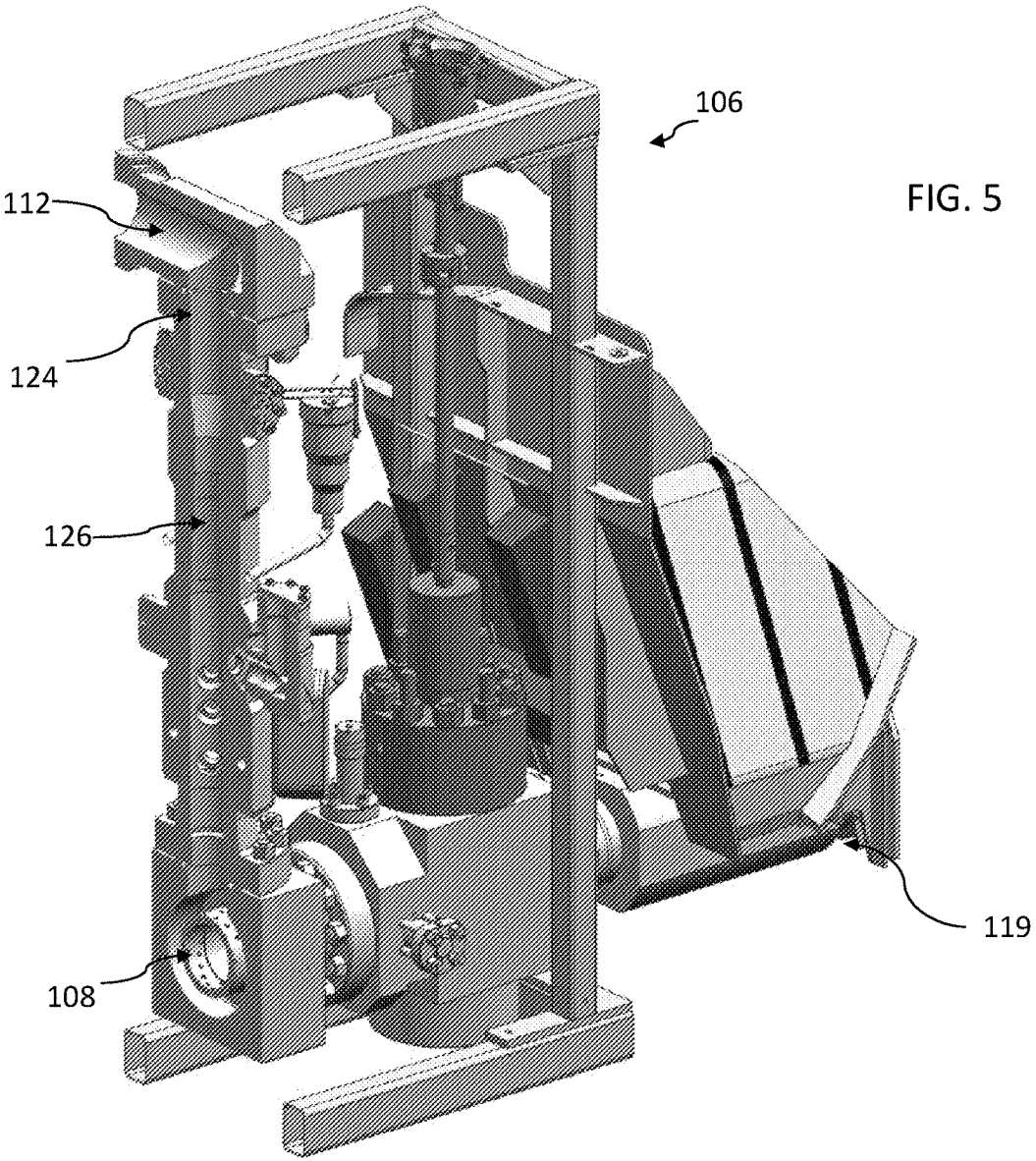
FIG. 5 is a partial sectional view of a vertical flow passage of the flow control module assembly of FIG. 2 in accordance with one or more embodiments of the present disclosure.

FIG. 5 illustrates a partial sectional view of vertical flow passage 124, including choke 109 disposed beneath a lower end of vertical flow passage 124.

In accordance with one or more embodiments, subsea tree 104, and flow control module 106 may be landed together or substantially simultaneously onto the subsea wellhead (not shown). In other embodiments, subsea tree 104 may be landed first and then flow control module 106 may be landed and coupled to subsea tree 104.

Advantageously, flow control module 106 may be separately landed independent from a flowline, such as a jumper, spool, or umbilical. Subsequently, according to one or more embodiments, a flow line, such as a jumper, spool, or umbilical, may be connected to outlet hub 119 of flow control module 106. Flow control module 106 may be retrievable to the surface in order to conduct repairs, inspection, or replacement of any components of flow control module 106 by disconnecting connector 110 located between tree frame 105 and flow control module 106.

Government regulations typically require at least two barriers (e.g., valves that may be selectively closed and regulated) be included in a subsea tree, such as subsea tree 104, to protect the environment, particularly the marine environment, from fluids flowing up through a subsea tree from a reservoir. In accordance with one or more embodiments, subsea tree 104 may include a number of valves, including a master valve and a production wing valve, such as wing valve 107 shown in FIG. 3, which may act as the necessary "barriers" required to protect the marine environment when flow control module 106 is removed.

According to one or more embodiments, subsea tree 104 may include passageways for hydraulic control fluid for a surface controlled subsurface safety valve (SCSSV) to isolate the wellbore fluids. Further, subsea tree 104 may include in one or more embodiments a production master valve (PMV) and a production wing valve (PWV) (e.g., 107 in FIG. 3). When these valves (SCSSV, PMV, and PWV) are closed, in one or more embodiments, flow control module 106 may be retrieved or removed from subsea tree 104. Access to a main bore (e.g., vertical bore 103) of subsea tree 104 may be provided after removal of the flow control module 106. The outlet on production wing block 114 may facilitate such main bore access of subsea tree 104 without requiring extensive well intervention. The main bore (e.g., vertical bore 103) and the valves of subsea tree 104 may be visually inspected and/or cleaned through the outlet provided in production wing block 114 once the flow control module 106 is removed via connector 110. For example, an ROV based borescope may be used to inspect a main bore and the valves located on subsea tree 104. Further, a washout tool or similar may be used to clean the main bore and the valves on subsea tree 104. Typical subsea flow control module/assemblies do not provide the ability to visually inspect or provide access to a main bore of a subsea tree or valves located a main bore of a subsea tree unless the entire subsea tree is retrieved to the surface and the tree is partially disassembled. In accordance with one or more embodiments disclosed herein, the flow control module 106 may be separately removed and access provided to a main bore of a subsea tree as well as to one or more valves without having to entirely retrieve the subsea tree to the surface.

In addition to the benefits described above, a lighter weight flow control module, such as flow control module 106 may further beneficially enable a lighter weight tree assembly that may reduce cost of the overall subsea tree system. A lighter weight of a tree and tree system may increase the range of vessels capable of installing a corresponding tree, thereby reducing the reliance on a limited number of multi service vessels (MSVs). It is noted that flow control module 106 may be used for onshore systems and surface trees as well.

Figure 6:
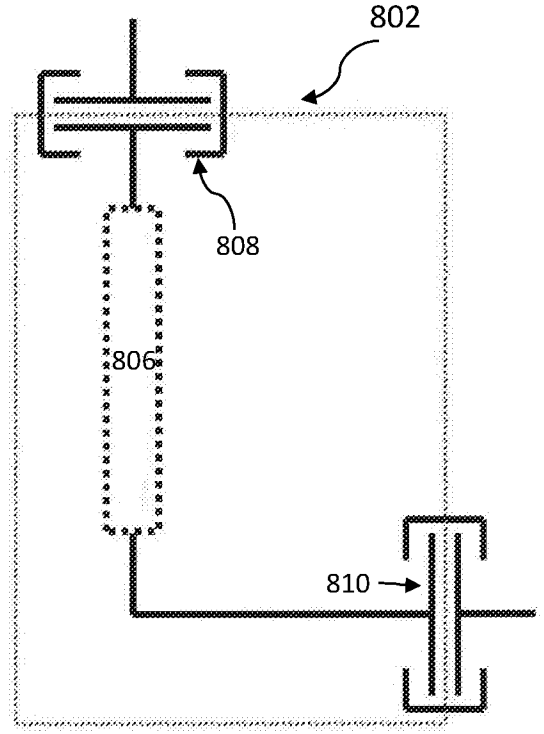
Prior Art FIG. 6
FIG. 6 shows a schematic view of a prior art flow control module assembly.

Flow control modules have been conventionally used to direct flow from one structure and are sometimes used to connect to another subsea structure. FIG. 6 shows flow control module 802, which is a conventional flow control module. Conventional flow control modules, such as flow control module 802, typically include a single inlet, such as inlet 808 and a single outlet, such as outlet 810, where the process (choke valve, measurements, etc.) as previously described is identified as 806. In conventional flow control modules, inlet 808 and outlet 810 may be provided as a single bore (as shown) or as a dual bore configuration, with both the inlet and outlet contained within a single connector. Nevertheless, only one outlet is provided.

Flow control modules that accommodate multiple tie-ins or connections to additional subsea equipment devices through a plurality of outlet hub (also known as outlets), such as the example flow control module 902 illustrated in FIG. 7, may be advantageous. As depicted, flow control module 902 may include an inlet 912 and at least two outlets, i.e., outlet 914 and 916. In other embodiments, flow control module 902 may include three outlets as shown in FIG. 8 and further discussed below. In other embodiments, flow control module 902, may include four, five, or six outlets or more as needed.

Referring to FIG. 7, flow control module 902 is a unit having multiple tie-in points or connections (i.e., tie-in connections 918) coupled to the outlets 914, 916 of the flow control module 902. Further, flow control module 902 is an apparatus that may be installed on another unit or base structure 930. Accordingly, in one or more embodiments, base structure 930 may be any type of subsea equipment, including a manifold, subsea tree, riser base, PLEMs, PLETs, or in-line tees. Base structure 930 may further include any well slot equipment such as a flowbase or tubing head, pipeline equipment, hydraulic distribution equipment, or similar. Flow control module 902 may be used for any type of service, including production and/or injection for any type of fluid.

According to embodiments of the present disclosure, flow control module 902 includes at least one main flow line (e.g., main line 920) and two additional branch flow lines (e.g., first branch line 922 and second branch line 924). Main line 920 as shown in FIG. 7 may be in fluid communication with one or more instruments or devices 906. Instruments or devices 906 may include flow control devices such as chokes. Further, instruments or devices 906 may include instruments such as flowmeters, pressure/temperature sensors, erosion/vibration monitors, injections points, sampling points, safety systems, processing/pumping equipment or similar.

In one or more embodiments, the first branch line 922 and/or the second branch line 924 may include the tie-in hubs or connectors 918 and specific isolation devices such as valves or other equipment depending on the system and field configuration. FIG. 7 shows instruments or devices 908 and 910, which may be instruments or devices suitable for the specific system within which flow control module 902 is located. In one or more embodiments, first branch line 922 and/or second branch line 924 may be located at any angle, position, or elevation relative to main line 920. Further, each of the lines (i.e., main line 920, first branch line 922, and second branch line 924) may have the same or different bore sizes relative to one another.

Flow control module 902 may be connected by a tie-in connection, e.g., tie-in connection 918 to subsea base structure 930. Tie-in connections 918 as shown in FIG. 7 may be provided at each outlet 912, 914, and 916 of flow control module 902. In other embodiments, tie-in connection 918 may be provided at only one or two of the outlets instead of all of the outlets 912, 914, and 916 on flow control module 902. In this embodiment, the outlet may be used for future expansion, such as daisy-chaining multiple wells together. The flow control module may include a blanking cap on the unused outlet that is removable to allow installation of a second jumper to connect the new well after it is completed.

Tie-in connections 918 may be configured as any kind of horizontal or vertical tie-in connection as known in the art. Further, tie-in connection 918 may be achieved using any tie-in systems suitable for the specific application to which flow control module 902 is configured. Further, tie-in connection 918 may be the same or different types of connections on each of the lines at the outlet points (e.g. 914 and 916). Tie-in connections 918 may be located at any angle, position, and elevation to connect with its mating equipment. In one or more embodiments, tie-in connection 918 may include any one of a clamp connector, collet connector, flange connector, or any type of connector.

In one or more embodiments, base structure 930 may be directly connected to flow control module 902 via a connector or may be connected using a flowline, such as, without limitation, a jumper, spool, or umbilical. Further, in one or more embodiments, flow control module 106 as described in FIGS. 1-5 may be connected to base structure 930. Further, in one or more embodiments, flow control module 106 (e.g., as shown in FIGS. 1-5) may be configured to include at least two or more outlets such as outlets 914 and 916 as shown in FIG. 7.

Tie-in connection 918 may be used to connect to any type of flowline, umbilical, or jumper spool using any tie-in tools known in the art. The present assignee has developed a series of Horizontal Tie-In systems which are designed to install and connect hydraulic and electrical umbilicals or jumpers between subsea modules and structures. Various configurations of jumpers and umbilicals may be used in conjunction with flow control module 902 to suit a variety of applications. The present assignee has further developed several Vertical Tie-In systems that may also be utilized to provide vertical connections for jumpers and umbilicals. These systems may include connectors that may be made up by hydraulic or non-hydraulic connectors.

In one embodiment, flow control module 902 may be connected to a manifold or similar type of subsea equipment. In such instances, in one or more embodiments, main line 920 may include instruments or devices 906 that are useful for a manifold header line. In addition, branch lines 922 and 924 may include instruments or devices 908 and 910 that are useful to a manifold branch line. In one or more embodiments, main line 920 is in fluid communication with branch line 922 and branch line 924. The various instruments or devices 906 located in main line 920 and instruments or devices 908 and 910 located in branch lines 922, 924 may control the flow of fluid. Accordingly, fluid may be configured to flow from main line 920 to branch line 922 and branch line 924 or vice versa. In other embodiments, fluid may be configured to flow to only branch line 922 or only branch line 924 depending on the type of flow control instruments and devices located in each line (e.g., main line or branch line) of flow control module 902. For example, in one or more embodiments, a choke may be included as a device in main line 920 and branch lines 922 and 924 in order to control fluid flow and/or direct fluid to a common export or outlet.

In one or more embodiments, flow control module 902 may be used to facilitate intervention operations. One type of well intervention operation that flow control module 902 may be used for is scale squeezing. Scale squeezing refers to one or more processes used to dissolve and remove unwanted scale build-up inside a production tubing in a subsea well in order to increase the oil recovery rate. This may be performed by injecting chemicals into the well using a chemical injection hose.

Another type of intervention operation that flow control module 902 may be used for is known as "pigging." Pigging refers to the process of using devices known as "pigs" to perform various maintenance operations on a pipeline. Pigging may be accomplished without stopping the flow of fluid in the pipeline. Pigging operations may include but are not limited to cleaning and inspecting the pipeline using a device that may be launched into a pipeline and received at a receiving trap located on the other end. Accordingly, in one or more embodiments, flow control module 902 may be used to perform intervention operations including without limitation scale squeezing, pigging, and hot oil circulation.

According to embodiments of the present disclosure, flow control module 902 may be useful for simplifying a field layout, minimizing a number of units installed subsea, as well as making the installed units more flexible and efficient for both current and future use. A single well development usually requires some sort of connection to additional independent equipment (e.g., manifolds, PLET, PLEM or similar) and it is desirable to provide options for any such future tie-in connections to enable field expansion at a later date. Intermediate flowlines such as jumpers that may be used to connect from a single well to such equipment will need tie-in points and access points, which flow control module 902 may provide.

Accordingly, in one or more embodiments, flow control module 902 may be connected to another subsea structure and any fluids that need to be injected into or produced from the subsea structure may be directed into or out one or more outlets (e.g. 914, and 916) of flow control module 902. Thus, flow control module 902 may provide numerous benefits and advantages due to its unique features. In another aspect, flow control module 902 may allow for "daisy chaining" another structure, such as a subsea tree within a field. Daisy chaining as referred to herein may describe the process of connecting several pieces of equipment or structures together, typically in series. Accordingly, flow control module 902 may provide tie-in connections for current and future use to another structure, such as a subsea tree or manifold, for well/flow line intervention or circulation of fluids.

In addition to the above, more than one flow control module may be connected to each other as part of a field layout. FIG. 8 shows an arrangement whereby more than one flow control module may be connected to each other. FIG. 8 illustrates flow control module 902 connected to flow control module 1002. In other embodiments, as many flow control modules may be connected to one another as needed to suit a specific application.

In one or more embodiments, flow control module 902 and flow control module 1002 include at least a single inlet hub and one outlet hub, although as noted previously, more outlet hubs may be included. In particular, flow control module 902 includes single inlet hub 912 and outlet hubs 914, 916 as shown in FIG. 7. Further, FIG. 8 illustrates that flow control module 902 includes a third outlet hub, i.e. outlet hub 918. Further, flow control module 1002 may include single inlet hub 1020 and outlet hubs 1032, 1034, and 1036.

In accordance with one or more embodiments, flow control module 106 as shown in FIGS. 1-5 may be utilized for flow control modules 902 and 1002 as shown in FIGS. 7 and 8. In such instances, flow control module 106 may be configured to include the specific number of outlets (e.g., two or three or more) to suit the specific application and installation requirements for each flow control module. Having a lighter weight flow control module 106 may contribute to lower costs of installation for a multi-well development of field 1114.

Flow control modules, such as flow control modules 902 and 1002 may offer a number of benefits over conventional systems. Flow control modules 902 and 1002 provide future tie-in points to add on or tie in to a manifold or similar structure without planning for such tie-ins early on during the initial field development. Having the future tie-in points on flow control modules 902 and 102 may allow for tie-ins to be added to the system at a later time without initial design consideration, and is a more cost-effective way to tie-into other subsea structures While the present disclosure has been described with respect to a limited number of embodiments, those skilled in the art, having benefit of this disclosure, will appreciate that other embodiments may be devised which do not depart from the scope of the disclosure as described herein. Accordingly, the scope of the disclosure should be limited only by the attached claims.

What is claimed:

1. A system comprising:

a first flow control module assembly comprising:

an inlet and at least two outlets;

a main line having a main flow passage that is in fluid communication with the inlet;

a first branch line having a first branch flow passage fluidly connected to the main flow passage, wherein the first branch line is coupled to the main line and extends from the main line to a first outlet of the at least two outlets; and a second branch line having a second branch flow passage fluidly connected to the main flow passage, wherein the second branch line is coupled to the main line and extends from the main line to a second outlet of the at least two outlets;

wherein the main line, the first branch line, and the second branch line are formed of pipes that are connected together to form the first flow control module assembly; and wherein the main line terminates at the first branch line and the second branch line; and a connector coupled to both the inlet of the first flow control module assembly and an equipment device.

2. The system of claim 1, wherein the equipment device is one of a manifold, a subsea tree or a subsea structure.

3. The system of claim 1, wherein the first flow control module assembly has at least three outlets.

4. The system of claim 1, further comprising a second flow control module assembly coupled, in series, to the first flow control module assembly.

5. The system of claim 4, wherein an outlet of the at least two outlets of the first flow control module is coupled to an inlet of the second flow control module assembly.

6. The system of claim 5, wherein the second flow control module assembly has at least one outlet.

7. The system of claim 6, wherein a main line of the second flow control module assembly is in fluid communication with a branch line of the first flow control module assembly.

8. A method of using a flow control module assembly, comprising:

providing a first flow control module assembly comprising a first branch line and a second branch line fluidly connected to a main line, wherein the first branch line, the second branch line, and the main line are formed of a plurality of connected together pipes and components;

connecting the first flow control module assembly to a first equipment device comprising:

connecting the main line of the first flow control module assembly to the first equipment device; and flowing fluid through the main line of the first flow control module assembly to the first branch line; and connecting a main line of a second flow control module to the first branch line of the first flow control module and flowing the fluid from the first flow control module assembly through the main line of the second flow control module, wherein the second branch line of the first flow control module is connected to either a second equipment device or a blanking cap, and wherein the second equipment device is different to both the first equipment device and the second flow control module.

9. The method of claim 8, further comprising flowing the fluid through one or more branch lines of the second flow control module.

10. The method of claim 8, further comprising flowing the fluid through a flow control device disposed in at least one of the main line of the first flow control module or the at least one branch line.

11. The method of claim 8, wherein the first flow control module assembly is connected to the equipment device via a separate first connector, and wherein the first flow control module assembly is connected to the second flow control module via a separate second connector.

12. The method of claim 8, wherein the first flow control module assembly further comprises a frame containing the main line, the first branch line, and the second branch line.

13. A system comprising:

a flow control module assembly comprising:

multiple flow lines formed of connected together components and pipework, the multiple flow lines comprising:

a main line having a main flow passage that is in fluid communication with an inlet;

a first branch line having a first branch flow passage fluidly connected to the main flow passage, wherein the first branch line is coupled to the main line and extends from the main line to a first outlet; and a second branch line having a second branch flow passage fluidly connected to the main flow passage, wherein the second branch line is coupled to the main line and extends from the main line to a second outlet; and a frame containing the multiple flow lines; and a connector coupled to the inlet of the flow control module assembly, wherein the first outlet is fluidly connected to a first equipment device and wherein the second outlet is fluidly connected to a second equipment device, and wherein the first equipment device is different than the second equipment device.

14. The system of claim 13, wherein the connector is selected from a collet connector, a clamp connector, and a flanged connector.

* * * * *